US005179233A

United States Patent [19]

du Plessis

[11] Patent Number: 5,179,233

[45] Date of Patent: Jan. 12, 1993

[54] PISTOL

[76] Inventor: Alexander B. du Plessis, 88 Wendy Road, Wendywood, Sandton, Transvaal Province, South Africa

[21] Appl. No.: 791,056

[22] Filed: Nov. 12, 1991

[51] Int. Cl.[5] ..... F41A 19/32

[52] U.S. Cl. ..... 42/69.02

[58] Field of Search ..... 42/69.02, 69.01, 65; 89/27.11, 27.14

[56] References Cited

U.S. PATENT DOCUMENTS

| | | | |
|---|---|---|---|
| 220,785 | 10/1879 | Barthel | 42/69.01 |
| 1,047,671 | 12/1912 | Mauser | 42/69.02 |
| 1,418,021 | 5/1922 | Reifgraber | 42/69.02 |
| 2,248,970 | 7/1941 | Decker et al. | 42/69.02 |
| 2,888,768 | 6/1959 | Taylor | 42/69.01 |
| 2,902,788 | 9/1959 | Laager | 42/69.01 |
| 4,539,889 | 9/1985 | Glock | 89/147 |

FOREIGN PATENT DOCUMENTS

| | | | |
|---|---|---|---|
| 1210837 | 3/1960 | France | 42/69.02 |
| 63510 | 5/1941 | Norway | 42/69.02 |
| 8606115 | 10/1986 | PCT Int'l Appl. . | |
| 805571 | 12/1958 | United Kingdom | 42/69.02 |

*Primary Examiner*—Stephen M. Johnson
*Attorney, Agent, or Firm*—Ladas & Parry

[57] ABSTRACT

A pistol has a trigger 18 pivotal between a forward rest and a rearward depressed condition. It has a firing pin assembly 60 incorporating a firing pin 68 and a transverse nose 74. The assembly 60 is translational parallel to a barrel. When in rearward, cocked condition as illustrated, a firing pin 76 is compressed to propel it forward when released. A transmission member 50 is pivoted at a fore end to the trigger 18 and is guided for displacement along a cocking path. The nose 74 extends into the cocking path. Depression of the trigger displaces the member 50 along the cocking path. The member 50 abuts the nose 74 and cocks the assembly 60. The invention provides a pivot member 64 which hooks onto the member 50 and deflects it out of its cocking path to release the nose when the assembly 60 is cocked. A resetting formation 96 is provided on a movable slide 14 to reverse pivot the pivot member 64 to disengage it from the member 50 when a cartridge has been fired.

7 Claims, 4 Drawing Sheets

PISTOL

BACKGROUND OF THE INVENTION

THIS INVENTION relates to a pistol. More particularly this invention relates to a pistol and to a method of operating a pistol.

SUMMARY OF THE INVENTION

In accordance with this invention, in operating a pistol which pistol comprises a trigger movable between a rest and a depressed position;

a firing pin assembly which is operatively associated with a firing pin for firing a cartridge in use and which is movable between a cocked condition remote from a cartridge chamber and a fire condition proximate the cartridge chamber; and resilient biasing means biasing the firing pin assembly to its fire condition, there is provided the method of transmitting motion of the trigger, when being depressed, to the firing pin assembly by displacing a transmission member which is operatively arranged between the trigger and the firing pin assembly, via a cocking path, to displace the firing pin assembly against its bias towards its cocked condition; and deflecting the transmission member transversely out of its cocking path to release the firing pin assembly when in its cocked condition and allowing the firing pin assembly to be propelled by its biasing means to its fire condition to fire a cartridge.

The method may include guiding the firing pin assembly for translational displacement parallel to an axis of a barrel of the pistol.

Depressing the trigger may be pivotally about a lateral axis.

Deflecting the transmission member may be by engaging the transmission member by means of a pivot member, which is pivotal about an axis transverse to the cocking path. Engaging the transmission member may be by hooking a hook formation of the pivot member over a shoulder of the transmission member. Displacing the transmission member out of its cocking path may be downwardly. It may be by pivoting the transmission member about a pivotal mounting thereof.

The method may further include, after release of the firing pin assembly, the step of disengaging the pivot member from the transmission member. This may be effected by reverse-pivoting the pivot member, e.g. by means of a resetting formation provided for this purpose.

The invention also extends to a pistol comprising a trigger movable between a rest and a depressed position;

a firing pin assembly which is operatively associated with a firing pin and which is movable between a cocked condition remote from a cartridge chamber and a fire condition proximate the cartridge chamber;

resilient biasing means for biasing the firing pin assembly towards its fire condition;

a transmission member which is guided for movement along a cocking path and which is operatively arranged between the trigger and the firing pin assembly to be responsive to depression of the trigger to displace the firing pin assembly against its bias towards its cocked condition; and deflecting means arranged in relation to the cocking path to deflect the transmission member out of its cocking path to release the firing pin assembly when in its cocked condition.

The resilient biassing means may comprise a relatively long firing spring, arranged to be operable under compression for propelling the firing pin assembly towards its fire condition. It may further include a relatively short return spring, arranged to be operable under compression for urging the firing element towards the cocked condition. Then, the long firing spring may be precalculated to have sufficient energy when the firing pin assembly is released from its cocked condition to dominate the short return spring to propel the firing pin assembly to its fire condition and to have insufficient energy when the firing pin assembly is released from a position shy of the cocked condition to propel it to its fire condition. This is an important safety feature which will be described hereinafter in more detail.

The firing pin assembly may be in the form of a striker. It may thus be elongate, having a leading end proximate the cartridge chamber and a trailing end remote from the cartridge chamber. The leading end of the striker may provide the firing pin. The pistol may have guide means for guiding the striker for translational displacement parallel to an axis of a barrel of the pistol.

The firing pin assembly may have a nose arranged to extend transversely outwardly from the firing pin assembly to be in the cocking path and to interfere with the transmission member operatively to be abutted by the transmission member in use.

The deflecting means may include a pivot member which is pivoted about a pivotal axis transverse to the cocking path.

The pivot member may include a hook formation arranged releasably to engage the transmission member.

The pistol may include a resetting formation slidingly displaceable relative to the pivot member and arranged for reverse-pivoting the pivot member by pivoting it in a direction away from the transmission member, thereby to disengage the hook formation from the transmission member. Thus, in use, by disengaging the pivot member from the transmission member, the transmission member is freed to return to its cocking path.

The pistol may have a slide slidable to and fro along the frame. The pistol may have gas operated recoil means arranged, when a cartridge has been fired in use, to propel the slide rearwardly to eject a spent cartridge case and to allow a fresh cartridge to be chambered. Advantageously, the resetting formation may be fast with the slide. It may be in the form of a shoulder arranged, on the reverse stroke of the slide, to engage the pivot member and to pull it free of the transmission member.

BRIEF DESCRIPTION OF THE DRAWINGS

An embodiment of the invention will now be described as an example of the invention with reference to the accompanying diagrammatic drawings in which.

DETAILED DESCRIPTION OF THE PREFERRED EMBODIMENT

Figure 1:
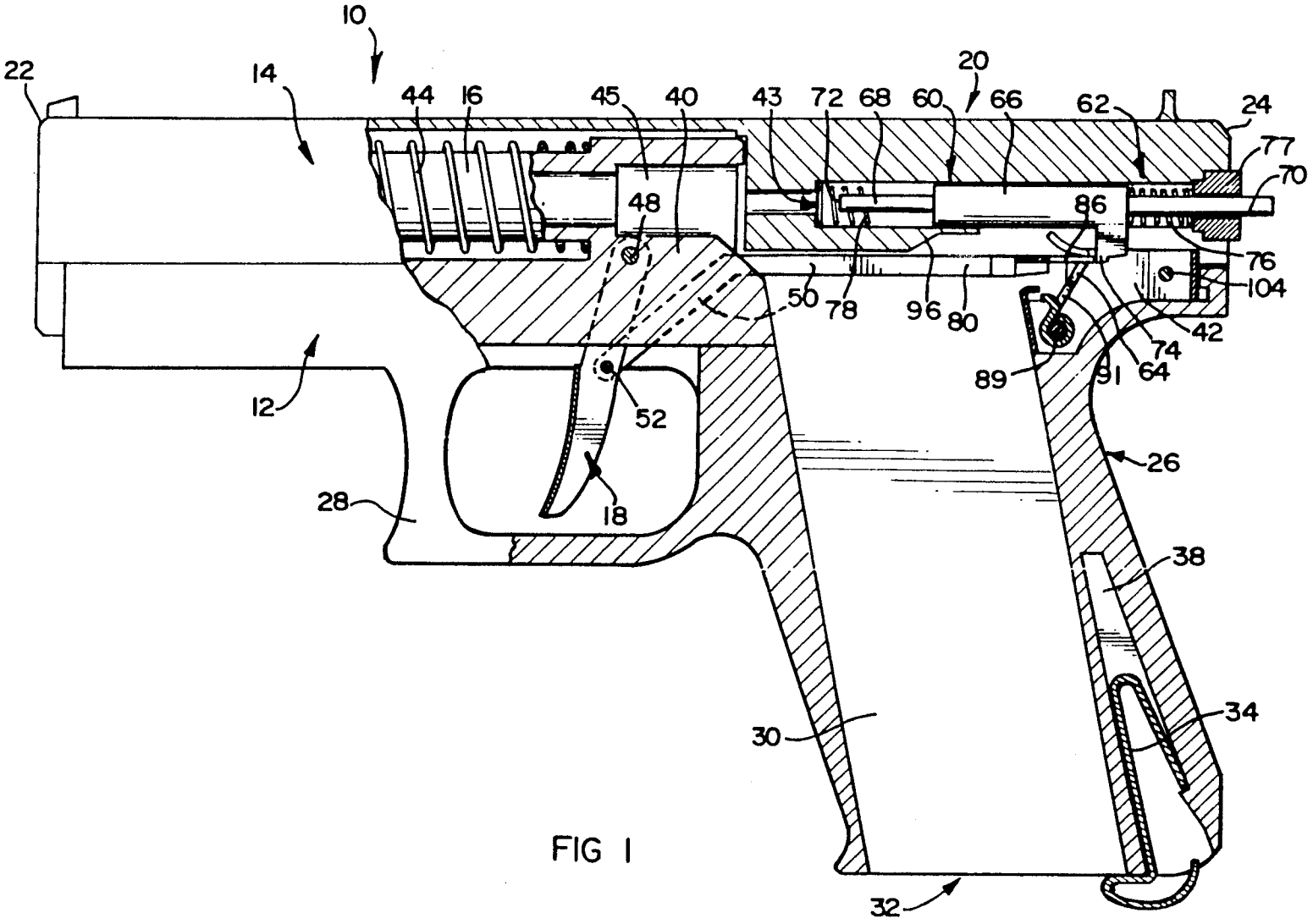
FIG. 1 is a part sectional side elevation of a pistol in accordance with the invention.

In FIG. 1, reference numeral refers generally to a pistol in accordance with the invention.

The pistol comprises broadly a frame 12, a slide 14 slidably mounted on the frame 12, a barrel 16 mounted to the frame 12, a trigger 18 and a firing mechanism indicated generally by 20.

The frame 12 which is of high impact fiber reinforced polymer has a muzzle end 22 and a rear end 24. It is in the form of an elongate, substantially rectangular, body having a transverse hand grip 26, integral with the body. The frame 12 is generally hollow and is open topped, the slide 14 being mounted over said open top.

A trigger guard 28, integral with both the body and the hand grip 26, guards the trigger 18.

The hand grip 26 is hollow to define a magazine well 30, to accommodate a cartridge carrying magazine (not shown). The magazine well 30 opens to the exterior via an opening 32 at a free end of the hand grip 26.

A retaining spring clip 34 for retaining a magazine in the magazine well 30 is mounted in a passage 38 provided for that purpose in the hand grip 26 so that the clip 34 extends across part of the opening 32. The clip 34 is resilient so that a user can urge the clip 34 clear of the opening 32 for enabling a magazine to be inserted into or withdrawn from the magazine well 30.

The slide 14 comprises an elongate, generally orthogonal, hood-like cover arranged over the open top of the frame 12. The slide 14 is of steel, is slidably mounted tongue-and-groove fashion to the frame 12, and is detachable from the frame 12.

The frame 12 has a locating recess for receiving a barrel support 40 positioned above the trigger 18 and a rear recess for receiving a rear support 42 towards its rear. The barrel support 40 is mounted to the frame 12, in its locating recess, by a cross pin (not shown). Similarly the rear support 42 is mounted to the frame 12, in its locating recess, by a further cross pin (not shown).

Part of the firing mechanism 20 is mounted to the rear support 42. Another part of the firing mechanism 20, which includes a firing pin assembly in the form of a striker, is located within an elongate passage 43 within the slide 14 and is arranged so that when the pistol 10 is assembled it is coaxial with the barrel 12.

Intermediate the elongate passage 43 and the barrel 16 and coaxial therewith is a cartridge chamber 45.

The barrel 16 is mounted to the frame 12 via the barrel support 40, the barrel 16 having at its rear the cartridge chamber 45 described above, for sequentially receiving cartridges to be fired. A helical recoil spring 44 is coiled around the outside of the barrel 16 of the pistol 10.

The trigger 18 is pivoted to the frame 12 via a cross pin 48 passing through an inner end of the trigger 18 and through associated apertures in the frame 12. The trigger 18 projects outwardly from the frame 12 into the space defined by the trigger guard 28.

The trigger 18 is movable between a forward, rest and a rearward, depressed position, being biased by a torsion spring (not shown) towards the rest position.

The trigger 18 is connected to the firing mechanism 20 via a transmission member 50 pivotally mounted to the trigger 18 at a point 52 intermediate the cross pin 48 and the free end of the trigger 18.

Figure 2:
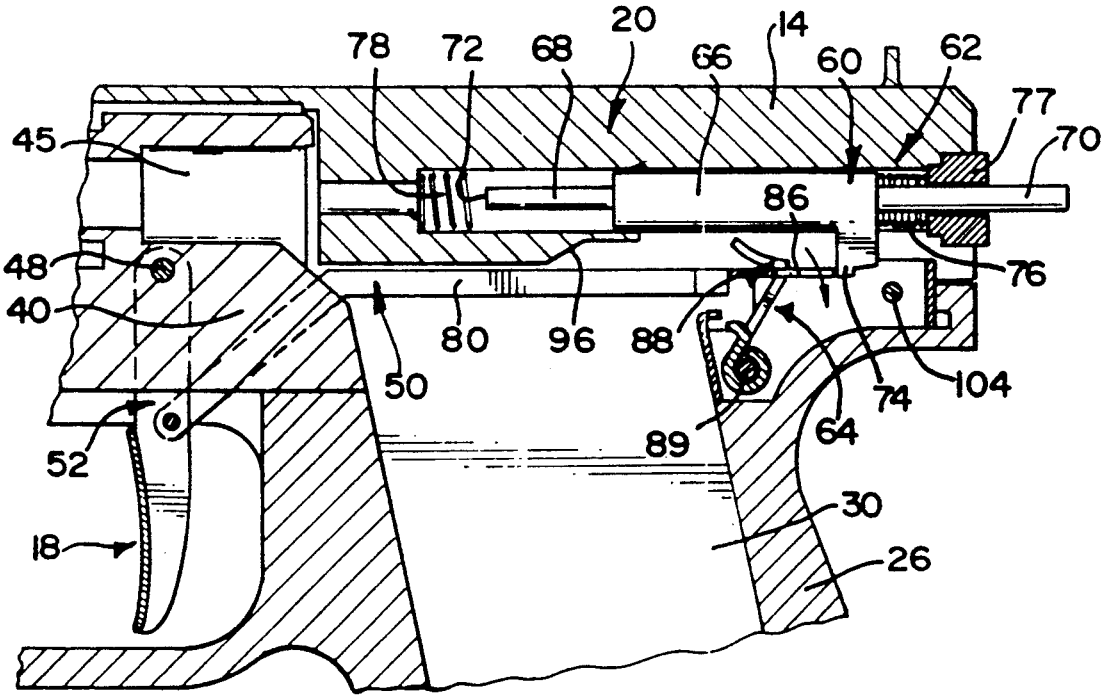
FIG. 2 is a sectional side elevation of a firing mechanism of the pistol of FIG. 1, in a condition in which a firing pin assembly is in a cocked condition.
Figure 3:
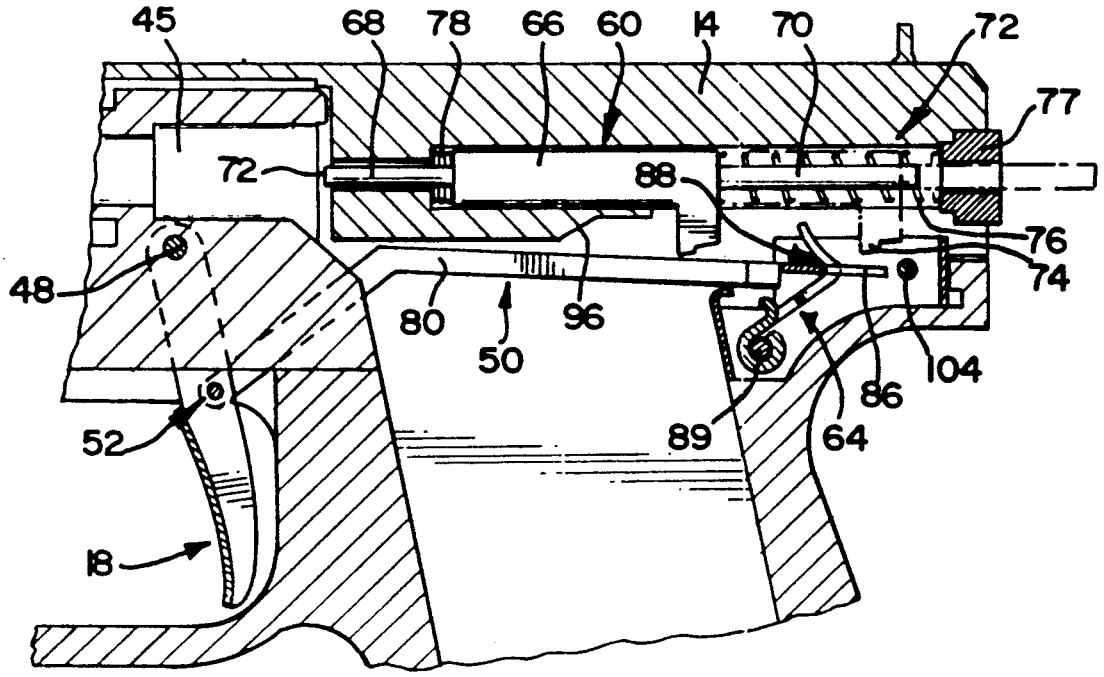
FIG. 3 corresponds to FIG. 2 but shows the firing pin assembly in a fire condition.
Figure 4:
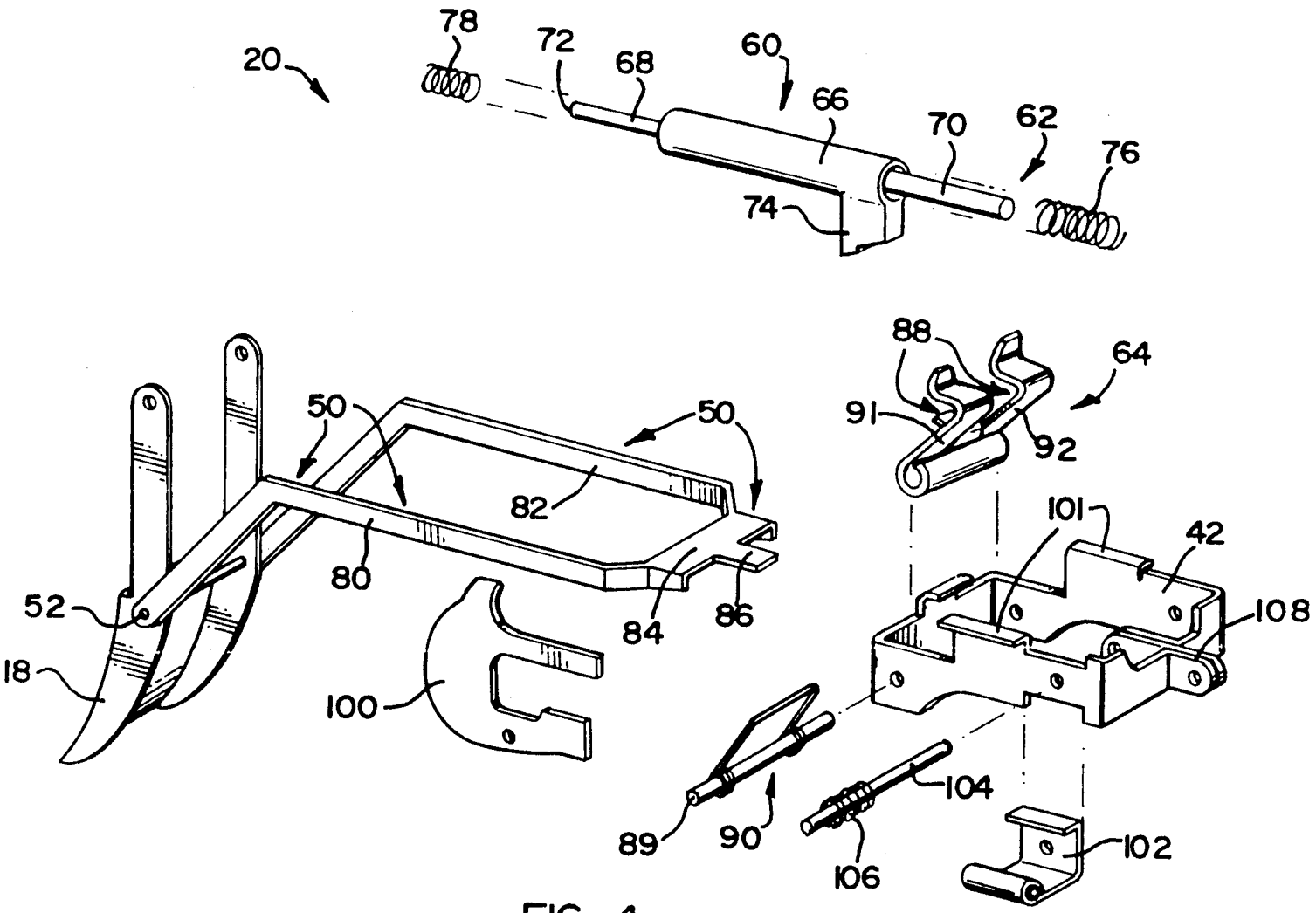
FIG. 4 is a three dimensional exploded view of the firing mechanism.

Referring now also to FIGS. 2 to 4 which are directed specifically to the firing mechanism, the firing mechanism 20 comprises broadly the transmission member 50 mentioned above; a firing pin assembly 60 movable between a rearward, cocked condition, remote from the cartridge chamber 45 and a forward, fire condition, proximate the cartridge chamber 45; resilient biasing means indicated generally by 62 for biasing the firing element to its fire condition; and a pivot member 64.

The firing element 60 is movably mounted to the slide 14 within the passage 43. The firing pin assembly 60 comprises a substantially cylindrical body, having a central body portion 66 of relatively wide diameter, and for and aft pins or shanks 68 and 70 of smaller diameter disposed coaxially in series at opposed ends of the central body portion 66. A free end of the pin 68, which is proximate the cartridge chamber 45, forms a firing pin 72 for striking the primer of a cartridge. The firing pin assembly 60 has a nose 74 extending transversely from the rear end of the central body portion 66. The nose 74 is arranged in a cocking path of the transmission member 50 for operatively abutting the transmission member 50.

The resilient biassing means 62 comprises a long action firing spring 76 received over the pin 70 and arranged under compression to propel the firing pin assembly 60 towards its fire condition with a relatively strong, predetermined, force. It is anchored in a base 77 releasably located in a rear mouth of the passage 43. A short return spring 78 is positioned toward the front of the firing pin assembly 60 for receipt over the pin 68 for urging the firing element 60 out of its fire condition towards its cocked condition.

The long action firing spring 76, on account of its longer stroke, has sufficient energy when the firing pin assembly 60 is in the cocked condition to generate sufficient momentum in the firing pin assembly 60 to dominate the short return spring 78 to cause the firing pin assembly 60 to be propelled to the fire condition. The long action firing spring 76 has insufficient energy when the firing pin assembly 60 is out of the cocked condition to move to the fire condition against the bias of the return spring.

As described above, the transmission member 50 is pivotally mounted to the trigger 18 at the point 52 spaced from the inner end of the trigger 18.

The member 50 comprises two closely spaced parallel limbs 80 and 82, each having one end connected to the trigger 18 at 52 and having an interconnecting web portion 84 at the opposed end. Projecting rearwardly outwardly from the web portion 84 is a tongue-like protrusion or sear 86 for operatively abutting the nose 74 of the firing pin assembly 60.

The transmission member 50 is displaceable translationally, along the cocking path substantially parallel to the axis of the barrel 16 by depressing the trigger 18.

The transmission member 50 can also be deflected transversely out of its cocking path by pivoting the member 50 about its pivotal mounting to the trigger 18 at 52. The member 50 is pivotal between an upper inclination corresponding to its cocking path and for engaging the nose 74 of the firing pin assembly 60 and a lower inclination in which the member 50 is displaced from its cocking path. The transmission member 50 is spring loaded towards its upper inclination via a torsion spring (not shown) associated with the trigger.

The pivot member 64 is in the form of a bifurcation, having limbs 91, 92, each of which comprises a hook formation 88. The pivot member 64 is pivotally mounted to the frame by means of a cross pin 89 and is thus pivotal about an axis transverse to the cocking path between an upper and a lower inclination. The pivot member 64 is spring biased towards its upper inclination by means of a torsion spring 90 associated therewith. The tongue-like protrusion 86 of the transmission member 50 protrudes through the space between the limbs 91 and 92 when assembled.

Referring now specifically to FIG. 4, reference numeral 100 refers to an ejecting formation for ejecting spent cartridges out of an ejection port (not shown) in the slide 14. The ejecting formation 100 is mounted to the rear support 42 by the cross pin 89. By way of development, the ejecting formation 100 may be integral with the rear support 42. Reference numeral 101 refers to guide rail formations for the tongue and groove engagement of the slide 14 to the frame 12. Reference numeral 102 refers to a detaching groove formation, which, when depressed, enables the slide 14 to be detached from the frame 12. The detaching formation 102 is mounted to the rear support 42 by means of a cross pin 104 and is displaceable within limits in a direction parallel to the axis of the pivot member 64. The formation 102 is biased outwardly by a spring coiled around the pin 104 and abutting at one end the formation 102 and at the other end a further formation 108.

In use, the pistol 10 has a cartridge carrying magazine (not shown) inserted into the magazine well 30. The magazine is a standard magazine for sequentially feeding cartridges, by spring loading, into the cartridge chamber 45.

The pistol 10 is cocked by moving the slide 14 towards the rear and releasing it, thereby allowing it to be moved forward under the bias of the recoil spring 44 until the nose 74 of the firing pin assembly 60 comes into operative abutment with the transmission member 50. The operative abutment is arranged to take place at a point intermediate its cocked and fire conditions, i.e. in a partially cocked condition.

Depressing the trigger 18 to fire a round, displaces the transmission member 50, which is pivotally mounted to the trigger 18 (as described above), via its cocking path, the firing pin assembly 60, which is in operative abutment with the transmission member 50 via the nose 74 and the sear 86, is displaced against its bias towards its cocked condition.

Displacement of the transmission member 50 via its cocking path causes it simultaneously releasably to engage the pivot member 64 and as the displacement progresses, the transmission member 50 is deflected out of its cocking path thus to release the firing pin assembly 60 at the point when the firing pin assembly 60 is in the cocked condition.

The firing pin assembly 60 then shoots towards its fire condition under the bias of the firing spring 76 which is sufficiently strong to overcome the return spring 78 to displace the firing pin 72 to the fire position. The firing pin 72 strikes the primer of a cartridge in the cartridge chamber 45, thus firing a bullet.

At this point the transmission member 50 is at its lower inclination out of its cocking path in which it is releasably engaged with the pivot member 64 by means of the hook formations 88.

Once the bullet has been fired, the recoil forces the slide 14 and associated firing pin assembly 60 back over the transmission member 50 and pivot member 64, towards the firing element's cocked condition. The travel of the firing pin assembly 60 is not impeded by the transmission member 50 as the member 50 is in its lower inclination.

As the slide 14 passes over the pivot member 64 a resetting formation 96 on the slide 14 abuts and engages the pivot member 64 displacing it further towards its lower inclination and disengaging it from the transmission member 50. This allows the transmission member 50 to return to its upper inclination and thus to its cocking path, operatively to abut and to engage the nose 74 of the firing pin assembly 60 as it moves from its cocked condition to its fire condition under the bias of the firing spring 76. The transmission member thus arrests the firing pin assembly in its cocked condition.

The pistol 10 can then be used by a user to fire a second round by depressing the trigger 18 to repeat the process.

The Applicant is aware of other pistols having polymer frames. However, as far as the Applicant is aware, all these pistols have metal inserts which have to be implanted during the molding process which is very time-consuming. Furthermore if any one of the metal inserts subsequently becomes damaged, the entire frame has to be discarded. Also, if the polymer frame becomes damaged, the metal inserts have to be discarded.

Instead, in pistols made in accordance with the Applicant's invention, the frame is molded having recesses into which the metal inserts can later be mounted. Thus if an insert should fail it can be removed from its mounting in the recess and replaced with a fresh insert. In this way the frame need not be discarded after a metal insert has failed. Furthermore, should the polymer frame fail, it can be replaced utilizing the existing metal inserts. Thus, the metal inserts can be re-used if the frame has to be discarded.

Pistols made in accordance with the invention have the further advantage that the recoil forces, generated when the weapon is fired, operate to urge the inserts more snugly into the locating recesses in the frame. Furthermore the barrel support is designed to spread the forces generated by the firing of a round. Thus, the loads on the frame are more evenly distributed, thus rendering the frame less prone to damage o failure.

The magazine clip 34 has the advantage that it requires merely a shoulder or step in the recess 38 to anchor it in the recess 38, i.e. it does not require a further separate component. It is held in position by its pair of outwardly urging spring-loaded limbs.

Pistols in accordance with the invention have the safety feature that the firing pin assembly can only be propelled to the fire condition when it is released from the fully cocked condition. Thus when the pistol is out of or shy of the cocked condition its firing pin assembly is in a position intermediate the cocked and fire conditions and even if the firing pin assembly is somehow released, e.g. through failure of a component, the firing spring 76 will not have sufficient energy to propel the firing pin against the bias of the return spring 78 into the cartridge chamber to fire a cartridge.

Figure 5:
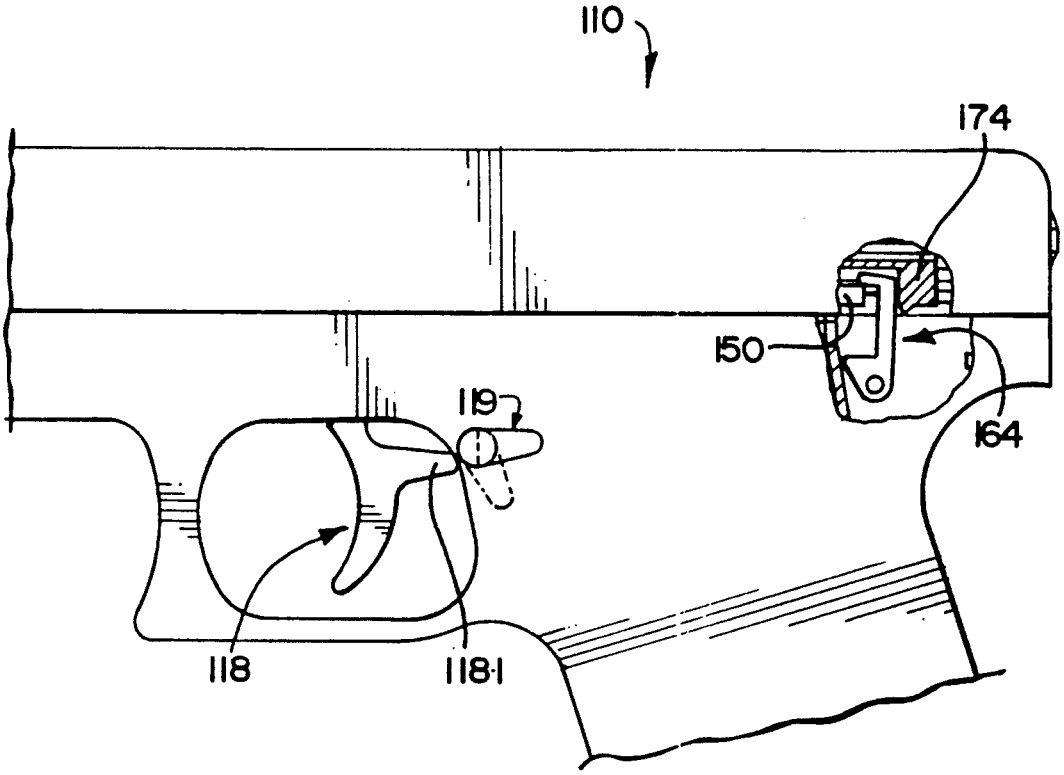
FIG. 5 is a fragmentary, partially cut away view of a developed embodiment of a pistol in accordance with the invention.

With reference to FIG. 5, a developed embodiment of the pistol is indicated by reference numeral 110. Its construction and operation are virtually identical to those of the pistol 10 and are not again described.

The pistol 110 has a safety pin 119 which co-operates in known manner with a horn 118.1 integral with and extending rearwardly from the trigger 118.

The pivot member 164 is of cast or forged construction instead of being of bent plate construction.

The embodiment 110 has all of the features and advantages of the embodiment 10 as described below.

The Applicant believes that his invention provides a pistol that has a smoother, more consistent trigger action (the same trigger pressure is required for first and for subsequent shots) providing improved accuracy over other pistols known to the Applicant. Also, a pistol in accordance with the invention is of light weight compact construction and its construction facilitates manufacture.

The Applicant is aware of pistols in which, when the first cartridge is fired, depressing the trigger causes the firing pin assembly or hammer to be displaced to the cocked condition and released. However subsequent rounds require depressing of the trigger only to release the firing pin assembly from its cocked condition, the firing pin assembly having already been displaced to the cocked condition by the recoil from firing a previous round.

I claim:

1. A method of operating a pistol which pistol comprises:

a trigger movable between a rest and a depressed position;

a firing pin assembly which is operatively associated with a firing pin for firing a cartridge in use and which is movable between a cocked condition remote from a cartridge chamber and a fire condition proximate said cartridge chamber; and resilient biasing means biasing said firing pin assembly to said fire condition, the method including:

transmitting the motion of said trigger, when being depressed, to said firing pin assembly by displacing a transmission member which is operatively arranged between said trigger and said firing pin assembly, via a cocking path, to displace said firing pin assembly against the bias of said biasing means towards said cocked condition;

hookingly engaging said transmission member, while said transmission member is being displaced, via a shoulder thereof by means of a hook formation provided for this purpose at a free end of a pivot member which is pivoted at a position remote from said free end about an axis transverse to said cocking path and pivoting said pivot member about said axis;

pulling said transmission member transversely out of said cocking path, in response to continued displacement of said transmission member, by means of said pivot member to release said firing pin assembly when in said cocked condition and allowing said firing pin assembly to be propelled by said biasing means to said fire condition to fire said cartridge.

2. A method as claimed in claim 1, in which said position at which said pivot member is pivoted is below said cocking path and in which said transmission member is pulled downwardly out of said cocking path.

3. A method as claimed in claim 1, which includes, after release of said firing pin assembly, the step of disengaging said pivot member from said transmission member in response to continued pivoting of said pivot member.

4. A pistol comprising:

a trigger movable between a rest and a depressed position;

a firing pin assembly which is operatively associated with a firing pin and which is movable between a cocked condition remote from a cartridge chamber and a fire condition proximate said cartridge chamber;

resilient biasing means for biasing said firing pin assembly towards said fire condition;

a transmission member which is guided for movement along a cocking path and which is operatively arranged between said trigger and said firing pin assembly to be responsive to depression of said trigger to displace said firing pin assembly against the bias of said biasing means towards said cocked condition; and deflecting means including a pivot member which is pivoted at one end thereof about a pivotal axis transverse to said cocking path and which includes, at a free end thereof remote from said one end, a hook formation, said pivot member being arranged in relation to said cocking path such that said hook formation is operatively aligned with said cocking path to engage in use a shoulder provided for this purpose on said transmission member, and such that continued movement of said transmission member pivots said pivot member to pull said transmission member out of said cocking path to release said firing pin assembly when in said cocked condition.

5. A pistol comprising:

a trigger movable between a rest and a depressed position;

a firing pin assembly which is operatively associated with a firing pin and which is movable between a cocked position remote from a cartridge chamber and a fire condition proximate said cartridge chamber;

resilient biasing means for biasing said firing pin assembly toward said fire condition;

a transmission member which is guided for movement along a cocking path and which is operatively arranged between said trigger and said firing pin assembly to be responsive to depression of said trigger to displace said firing pin assembly against the bias of said biasing means toward said cocked condition;

deflecting means including a pivot member which is pivotal about a pivotal axis transverse to said cocking path, said pivot member including a hook formation arranged releasably to engage said transmission member to deflect said transmission member out of said cocking path to release said firing pin assembly when in said cocked condition; and a resetting formation sildingly displaceable relative to said pivot member and arranged to contact said pivot member so as to further pivot said pivot member away from said transmission member and thereby disengage said hook formation from said transmission member.

6. A pistol as claimed in claim 5, which includes a frame, a slide slidable to and fro in forward and reverse directions along said frame, and gas operated recoil means arranged, when said cartridge has been fired, to propel said slide rearwardly to eject a spent casing of said cartridge and to allow a fresh cartridge to be chambered.

7. A pistol as claimed in claim 6, wherein said resetting formation is in the form of a shoulder which is arranged, during sliding of said slide in said reverse direction, to engage said pivot member and pull it free of said transmission member.

* * * * *